US010566682B2

(12) United States Patent
Chen

(10) Patent No.: US 10,566,682 B2
(45) Date of Patent: Feb. 18, 2020

(54) ANTENNA STRUCTURE AND WIRELESS COMMUNICATION DEVICE USING SAME

(71) Applicant: Chiun Mai Communication Systems, Inc., New Taipei (TW)

(72) Inventor: Chang-Je Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 61 days.

(21) Appl. No.: 15/703,998

(22) Filed: Sep. 14, 2017

(65) Prior Publication Data

US 2018/0090820 A1 Mar. 29, 2018

(30) Foreign Application Priority Data

Sep. 26, 2016 (CN) ..... 2016 1 0849556

(51) Int. Cl.

| | |
|---|---|
| ***H01Q 1/48*** | (2006.01) |
| ***H01Q 1/24*** | (2006.01) |
| ***H01Q 9/42*** | (2006.01) |
| ***H01Q 9/04*** | (2006.01) |
| ***H01Q 5/371*** | (2015.01) |
| ***H01Q 5/378*** | (2015.01) |
| *H01Q 1/12* | (2006.01) |
| *H01Q 1/36* | (2006.01) |

(52) U.S. Cl.

CPC ..... *H01Q 1/243* (2013.01); *H01Q 1/48* (2013.01); *H01Q 5/371* (2015.01); *H01Q 5/378* (2015.01); *H01Q 9/045* (2013.01); *H01Q 9/0421* (2013.01); *H01Q 9/42* (2013.01); *H01Q 1/1207* (2013.01); *H01Q 1/36* (2013.01)

(58) Field of Classification Search

CPC .. H01Q 1/48; H01Q 9/40; H01Q 9/43; H01Q 9/0407; H01Q 1/38; H01Q 1/243

USPC ..... 343/848, 841, 876, 700 MS, 829

See application file for complete search history.

(56) References Cited

U.S. PATENT DOCUMENTS

| | | | | |
|---|---|---|---|---|
| 2014/0361930 | A1* | 12/2014 | Liu | H01Q 1/243 343/700 MS |
| 2015/0155632 | A1* | 6/2015 | Lai | H01Q 1/243 343/700 MS |
| 2016/0049719 | A1* | 2/2016 | Tseng | H01Q 1/243 343/702 |
| 2016/0056545 | A1* | 2/2016 | Park | H01Q 1/243 343/702 |

FOREIGN PATENT DOCUMENTS

| | | |
|---|---|---|
| TW | 200701555 | 1/2007 |

* cited by examiner

*Primary Examiner* — Dameon E Levi
*Assistant Examiner* — Collin Dawkins
(74) *Attorney, Agent, or Firm* — ScienBiziP, P.C.

(57) ABSTRACT

An antenna structure includes an antenna body, a radiator, a connecting member, and a coupling member. The radiator is a monopole antenna and is spaced apart from the antenna body. The connecting member is electrically connected to the radiator and feeds current signals to the radiator. The coupling member is spaced apart from the antenna body and the antenna body is grounded through the connecting member.

16 Claims, 9 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201610849556.7 filed on Sep. 26, 2016, the contents of which are incorporated by reference herein.

FIELD

The subject matter herein generally relates to an antenna structure and a wireless communication device using the antenna structure.

BACKGROUND

Antennas are important elements of wireless communication devices, such as mobile phones or personal digital assistants. To communicate in multi-band communication systems, a bandwidth of an antenna in the wireless communication device needs to be wide enough to cover frequency bands of multiple bands. In addition, because of the miniaturization of the wireless communication device, space available for the antenna is reduced and limited.

BRIEF DESCRIPTION OF THE DRAWINGS

Implementations of the present technology will now be described, by way of example only, with reference to the attached figures.

DETAILED DESCRIPTION

Figure 1:
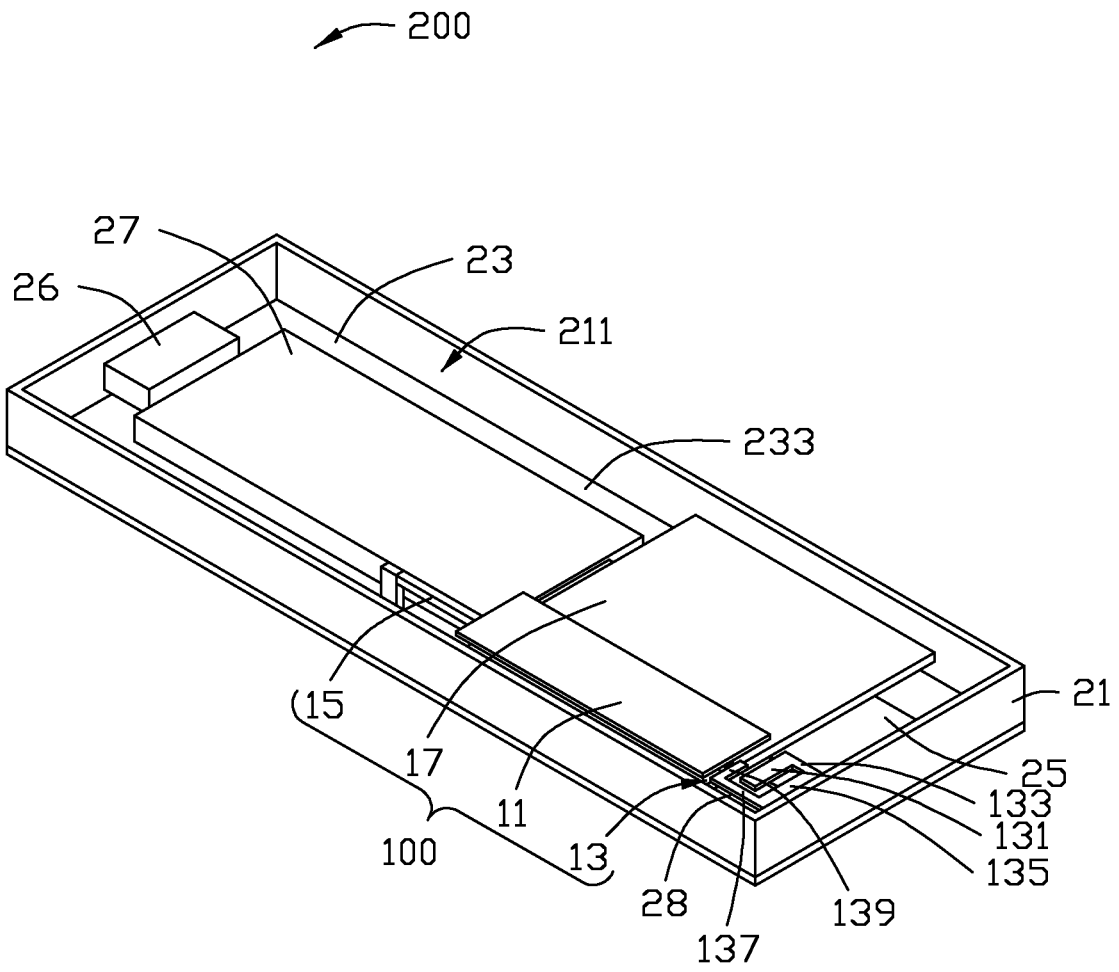
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200 using a first exemplary antenna structure 100. The wireless communication device 200 can be a mobile phone, a personal digital assistant, or a MP3 player, for example. In this exemplary embodiment, the wireless communication device 200 is a MP3 player.

The wireless communication device 200 includes a housing 21, a baseboard 23, and at least one electronic elements. The housing 21 may be made of insulation material, for example, plastic, rubber, glass, wood, ceramic, or the like. The housing 21 is substantially a rectangular frame and forms a receiving space 211. The receiving space 211 receives the antenna structure 100, the baseboard 23, and the electronic elements. In this exemplary embodiment, the baseboard 23 is a printed circuit board (PCB) and is made of dielectric material, for example, epoxy resin glass fiber (FR4) or the like.

The baseboard 23 is positioned at a side of the receiving space 211. The baseboard 23 includes a feed point 231 (shown in FIG. 2) and a ground plane 233. The feed point 231 provides current signal to the antenna structure 100. The ground plane 233 grounds the antenna structure 100.

In this exemplary embodiment, the wireless communication device 200 includes three electronic elements. The three electronic elements include a microphone 25, a Universal Serial Bus (USB) interference module 26, and a battery 27. The microphone 25 is positioned at a side of the receiving space 211 and is positioned relative to the baseboard 23. The USB interference module 26 is positioned on an end of the baseboard 23 away from the microphone 25. The battery 27 is positioned at a middle portion of the baseboard 23 and provides electric power to the wireless communication device 200.

In this exemplary embodiment, the wireless communication device 200 further includes a keep-out-zone 28. The purpose of the keep-out-zone 28 is to delineate an area on the baseboard 23 in which other electronic elements (such as a camera, a vibrator, a speaker, etc.) cannot be placed. The keep-out-zone 28 is positioned at the side of the receiving space 211 adjacent to the microphone 25. In this exemplary embodiment, the wireless communication device 200 has a dimension of about 39*117*7.5 $mm^3$. The keep-out-zone 28 has a dimension of about 13*10 $mm^2$.

The antenna structure 100 is positioned in the receiving space 211. The antenna structure 100 includes an antenna body 11, a radiator 13, a connecting member 15, and a coupling member 17. The antenna body 11 can be made of metallic material, for example, a copper sheet. In this exemplary embodiment, the antenna body 11 is substantially rectangular. The antenna body 11 is positioned between the baseboard 23 and the keep-out-zone 28. The antenna body 11 is attached on the housing 21 through glue or the like. The keep-out-zone 28 is surrounded by the antenna body 11, the microphone 25, and the housing 21. The antenna body 11 is further electrically connected to the ground plane 233 of the baseboard 23 to achieve a large area of grounding.

In this exemplary embodiment, the radiator 13 is a monopole antenna. The radiator 13 is positioned above the keep-out-zone 28 and spaced apart from the antenna body 11. The radiator 13 includes a first radiating section 131, a second radiating section 133, a third radiating section 135, a fourth radiating section 137, and a fifth radiating section 139 connected in that order. The first radiating section 131 is substantially rectangular. The first radiating section 131 is positioned parallel with the side of the antenna body 11 adjacent to the microphone 25.

The second radiating section 133 is substantially rectangular. The second radiating section 133 is perpendicularly connected to one end of the first radiating section 131 and extends away from the antenna body 11. The third radiating section 135 is substantially rectangular. The third radiating section 135 and the first radiating section 131 are positioned at a same side of the second radiating section 133. One end of the third radiating section 135 is perpendicularly connected to the end of the second radiating section 133 away from the first radiating section 131. Another end of the third radiating section 135 extends along a direction parallel to the first radiating section 131. The third radiating section 135, the first radiating section 131, and the second radiating section 133 cooperatively form a U-shaped structure.

In this exemplary embodiment, a width of the first radiating section 131 is greater than the third radiating section 135. The third radiating section 135 is longer than the first radiating section 131.

The fourth radiating section 137 is substantially rectangular. One end of the fourth radiating section 137 is perpendicularly connected to the end of the third radiating section 135 away from the second radiating section 133. Another end of the fourth radiating section 137 extends along a direction parallel to the second radiating section 133 and towards the antenna body 11. The extension continues until the fourth radiating section 137 passes over the first radiating section 131.

The fifth radiating section 139 is substantially rectangular. One end of the fifth radiating section 13 is perpendicularly connected to the end of the fourth radiating section 137 away from the third radiating section 135. Another end of the fifth radiating section 139 extends along a direction parallel to the first radiating section 131 and towards the second radiating section 133. In this exemplary embodiment, the fourth radiating section 137 is longer than the second radiating section 133. The fifth radiating section 139 is positioned between the antenna body 11 and the first radiating section 131.

Figure 2:
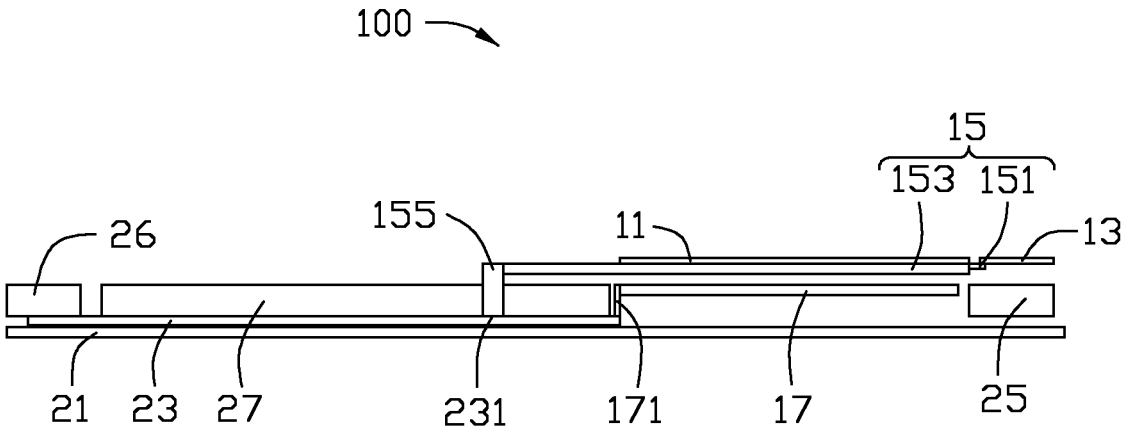
FIG. 2 is similar to FIG. 1, but shown from another angle.

As illustrated in FIG. 2, in this exemplary embodiment, the connecting member 15 is a coaxial cable. The connecting member 15 includes an inner conductor 151 and an outer conductor 153. One end of the inner conductor 151 is electrically connected to the feed point 231 of the baseboard 23 through a connecting portion 155. Another end of the inner conductor 151 is electrically connected to the radiator 13. For example, another end of the inner conductor 151 is electrically connected to the fifth radiating section 139 of the radiator 13 for feeding current signal from the baseboard 23 to the radiator 13.

One end of the outer conductor 153 is electrically connected to the ground plane 233 through the connecting portion 155. Another end of the outer conductor 153 is electrically connected to the antenna body 11. Then the antenna body 11 is electrically connected to the ground plane 233 of the baseboard 23 through the outer conductor 153 of the connecting member 15 to achieve a large area of grounding.

In other exemplary embodiments, the connecting member 15 is not limited to be the coaxial cable and can be other type of connecting member. The connecting member 15 supplies current signal to the radiator 13 and grounds the antenna body 11.

The coupling member 17 is made of metallic material. In this exemplary embodiment, the coupling member 17 may be a metallic back frame bracket of the wireless communication device 200, for example, the metallic back frame bracket of a display unit (not shown) of the wireless communication device 200. The coupling member 17 and the antenna body 11 are stacked in the receiving space 211. The coupling member 17 and the antenna body 11 are further positioned between the baseboard 23 and the microphone 25. The antenna body 11 and the radiator 13 are positioned at a lower right corner of the wireless communication device 200, that is, a lower left side of the microphone 25. The coupling member 17 is positioned at an upper right corner of the wireless communication device 200, that is, an upper left side of the microphone 25.

The coupling member 17 is spaced apart from the antenna body 11. Then the coupling member 17 is capacitively coupled to the antenna body 11. The coupling member 17 is only spaced apart from the antenna body 11 and is not grounded, that is, the coupling member 17 is floated. In other exemplary embodiments, the coupling member 17 is spaced apart from the antenna body 11 and is also grounded. For example, as illustrated in FIG. 2, the coupling member 17 is electrically connected to the ground plane 233 through a ground portion 171 to add a grounding area of the antenna structure 100.

Figure 3:
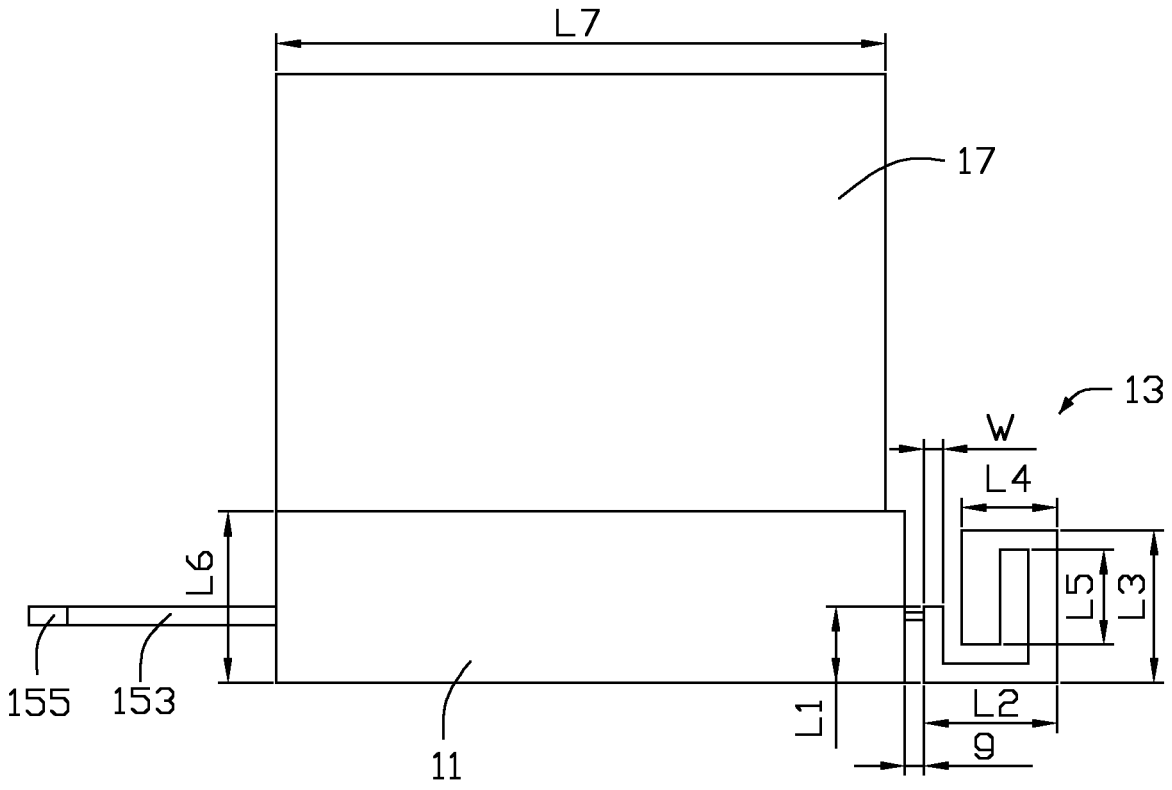
FIG. 3 is a dimension graph of the antenna structure of FIG. 1.

FIG. 3 is a plan view of the antenna body 11, the radiator 13 and the coupling member 17 of the antenna structure 100 shown in FIG. 1. A length of the fifth radiating section 139 of the radiator 13 is L1. A width of the fifth radiating section 139 is set as W. A length of the fourth radiating section 137 is set as L2. A length of the third radiating section 135 is set as L3. A length of the second radiating section 133 is set as L4. A length of the first radiating section 131 is set as L5. A distance between the fifth radiating section 139 and the antenna body 11 is set as g. A width of the antenna body 11 is set as L6. A length of the coupling member 17 is set as L7. In this exemplary embodiment, L1=6 mm, L2=9 mm, L3=10 mm, L4=L5=6 mm, g=1 mm, L6=12 mm, and L7=33 mm.

Figure 4:
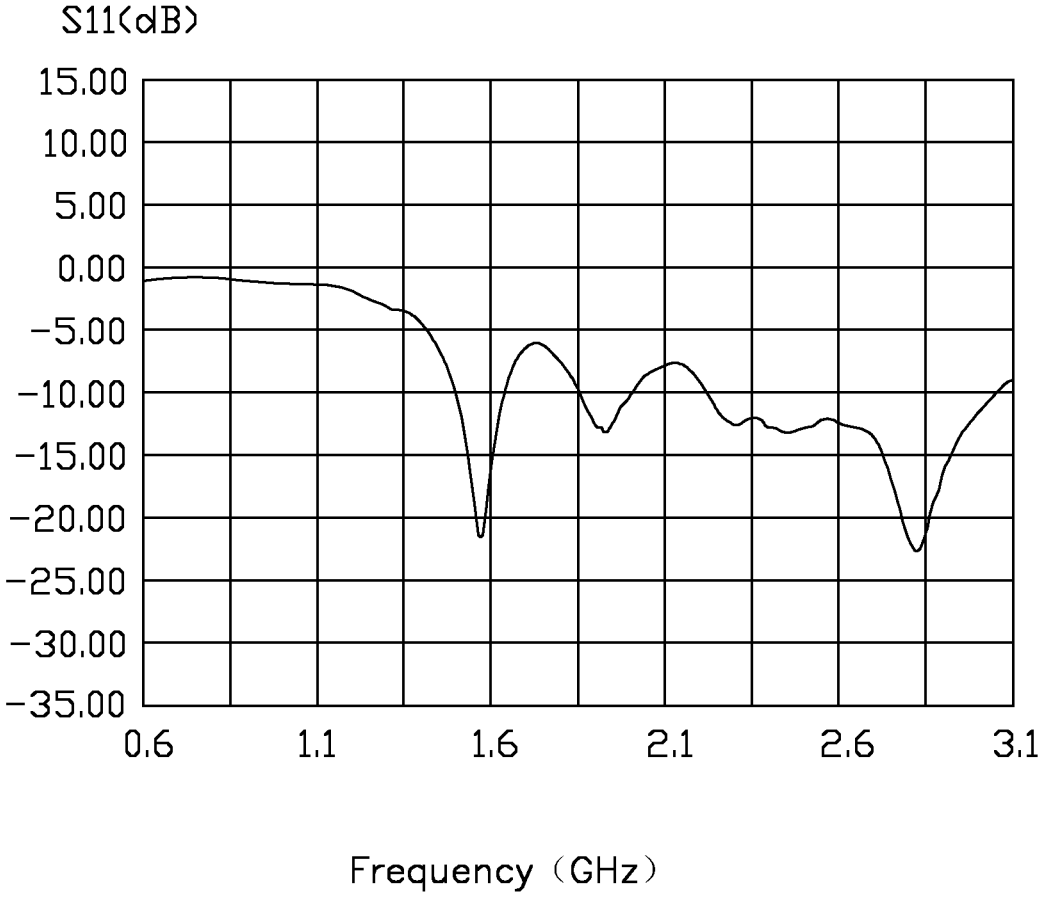
FIG. 4 is a scattering parameter graph of the antenna structure of FIG. 1.

FIG. 4 is a scattering parameter graph of the antenna structure 100 when L1=6 mm, L2=9 mm, L3=10 mm, L4=L5=6 mm, g=1 mm, L6=12 mm, and L7=33 mm.

Figure 5:
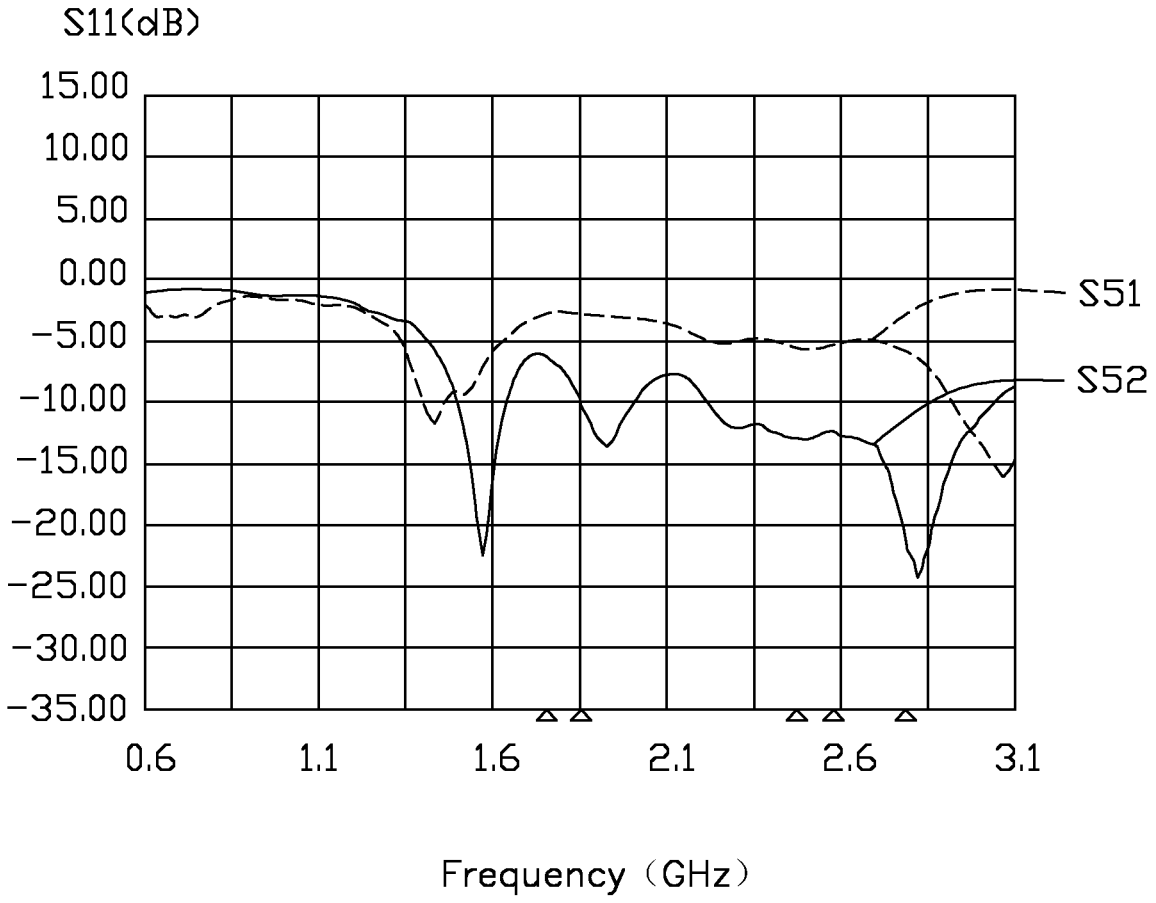
FIG. 5 is a scattering parameter graph illustrating the antenna structure of FIG. 1 includes an antenna body and does not include the antenna body.

FIG. 5 is a scattering parameter graph when the antenna structure 100 includes the antenna body 11 and does not include the antenna body 11, and when L1=6 mm, L2=9 mm, L3=10 mm, L4=L5=6 mm, g=1 mm, L6=12 mm, and L7=33 mm. Curve S51 illustrates a scattering parameter when the antenna structure 100 does not include the antenna body 11. Curve S52 illustrates a scattering parameter when the antenna structure 100 includes the antenna body 11.

Figure 6:
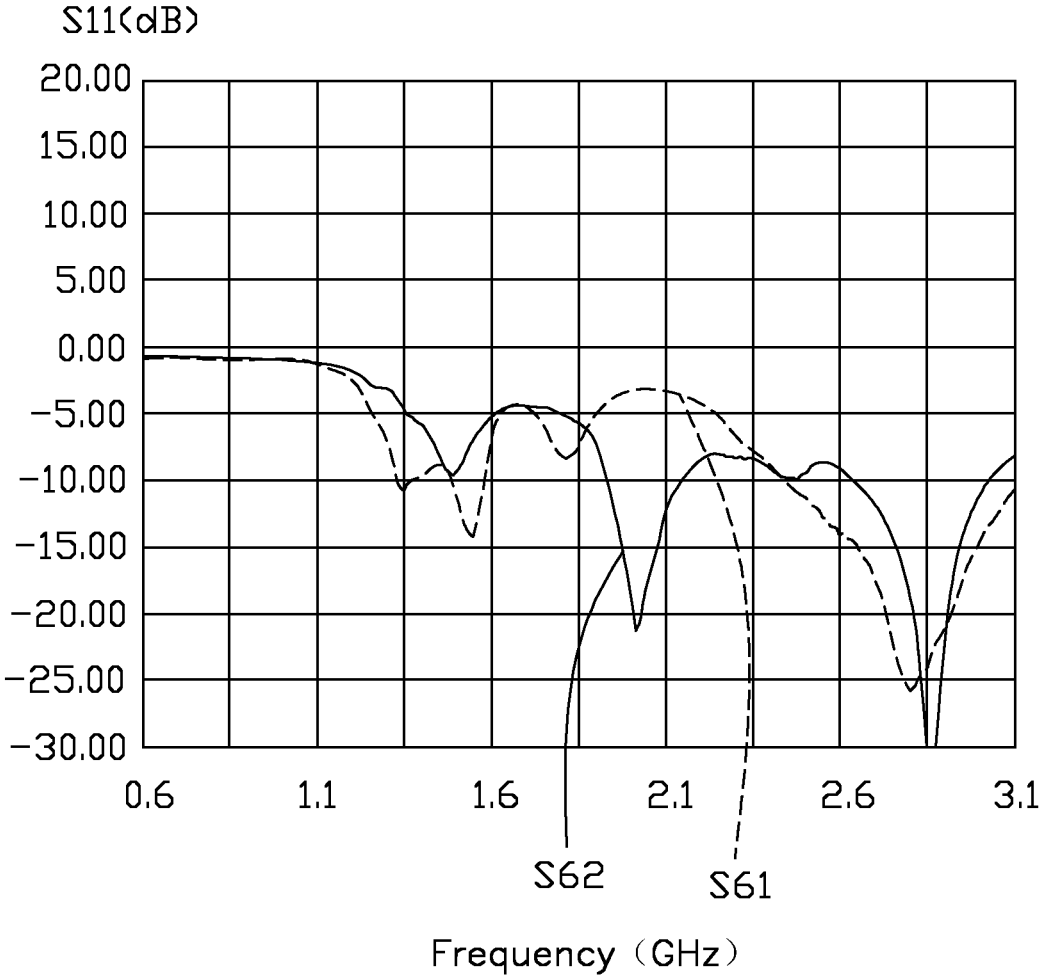
FIG. 6 is a scattering parameter graph illustrating the antenna structure of FIG. 1 includes a coupling member and does not include the coupling member.

FIG. 6 is a scattering parameter graph when the antenna structure 100 includes the coupling member 17 and does not include the coupling member 17, and when L1=6 mm, L2=9 mm, L3=10 mm, L4=L5=6 mm, g=1 mm, L6=12 mm, and L7=33 mm. Curve S61 illustrates a scattering parameter when the antenna structure 100 does not include the coupling member 17. Curve S62 illustrates a scattering parameter when the antenna structure 100 includes the coupling member 17.

Figure 7:
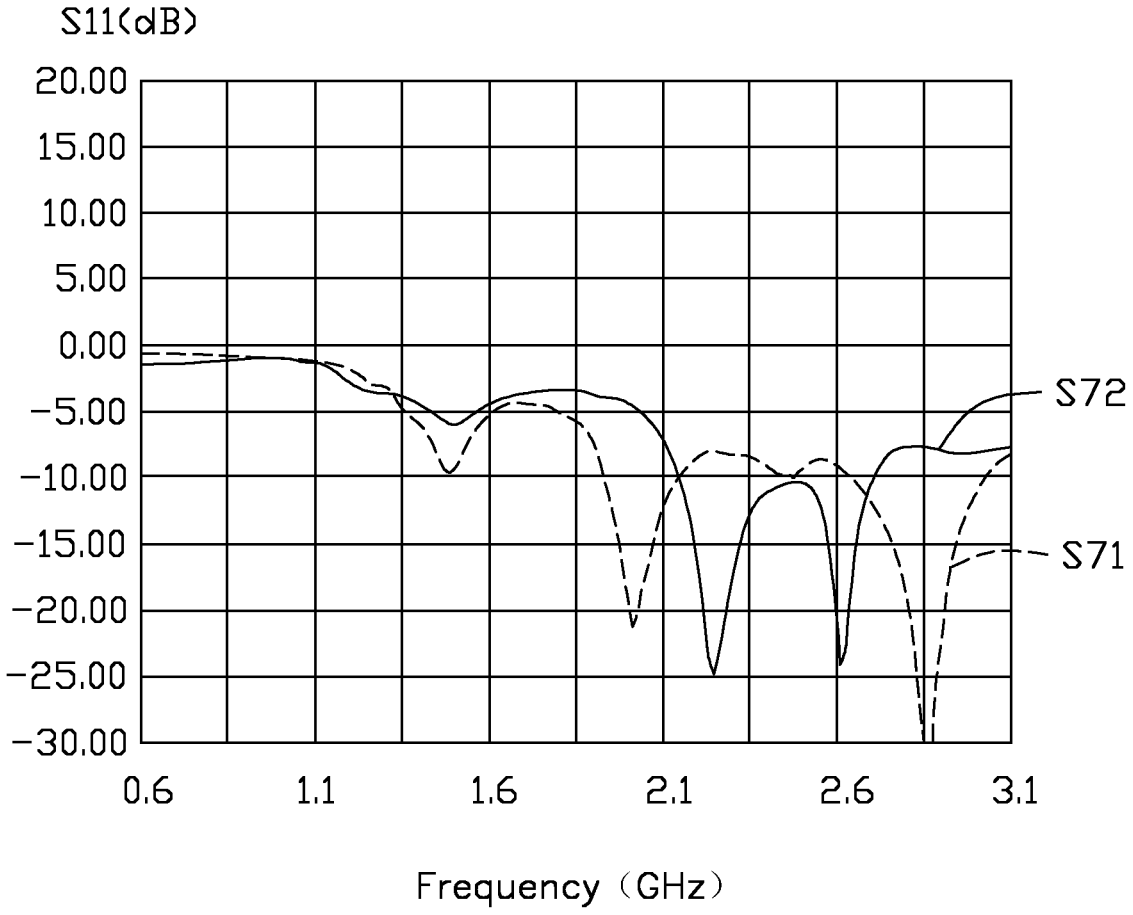
FIG. 7 is a scattering parameter graph illustrating the coupling member is grounded and is not grounded.

FIG. 7 is a scattering parameter graph when the coupling member 17 of the antenna structure 100 is grounded and is not grounded, and when L1=6 mm, L2=9 mm, L3=10 mm, L4=L5=6 mm, g=1 mm, L6=12 mm, and L7=33 mm. Curve S71 illustrates a scattering parameter when the antenna structure 100 includes the coupling member 17 and the coupling member 17 is not grounded. Curve S72 illustrates a scattering parameter when the antenna structure 100 includes the coupling member 17 and the coupling member 17 is grounded.

Figure 8:
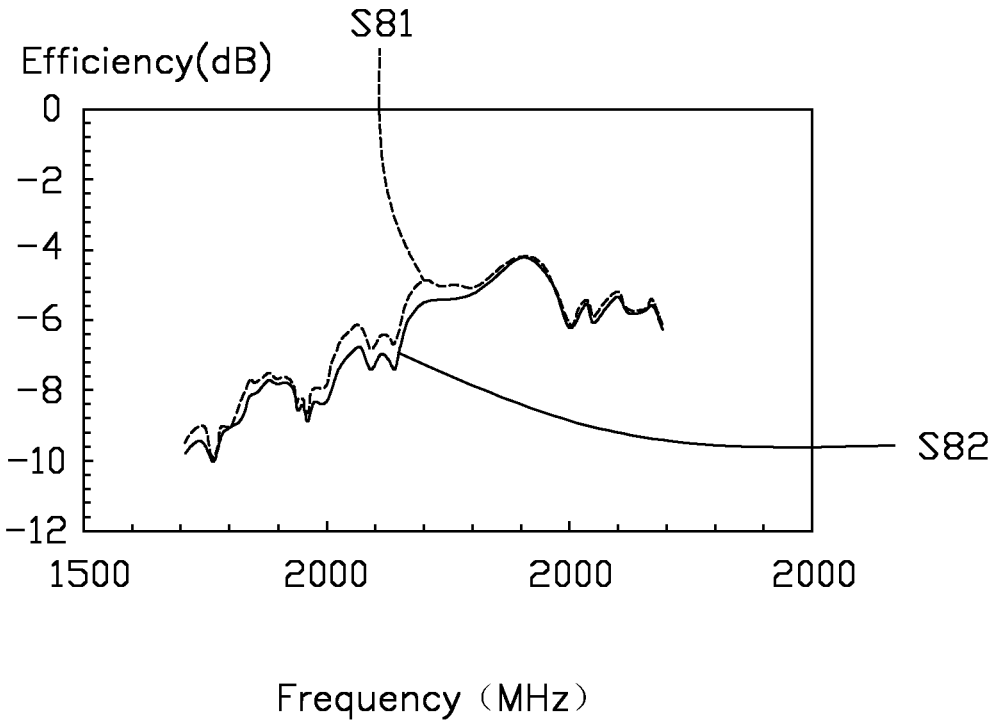
FIG. 8 is a radiating efficiency graph of the antenna structure of FIG. 1.

FIG. 8 is a radiating efficiency graph of the antenna structure 100 when L1=6 mm, L2=9 mm, L3=10 mm, L4=L5=6 mm, g=1 mm, L6=12 mm, and L7=33 mm. Curve S81 illustrates a radiating efficiency of the antenna structure 100. Curve S82 illustrates a total radiating efficiency of the antenna structure 100.

In views of FIG. 4 to FIG. 8, the antenna structure 100 can at least work at a frequency band of 1710-2700 MHz and has a good radiating performance when the antenna structure 100 works at this frequency band.

Figure 9:
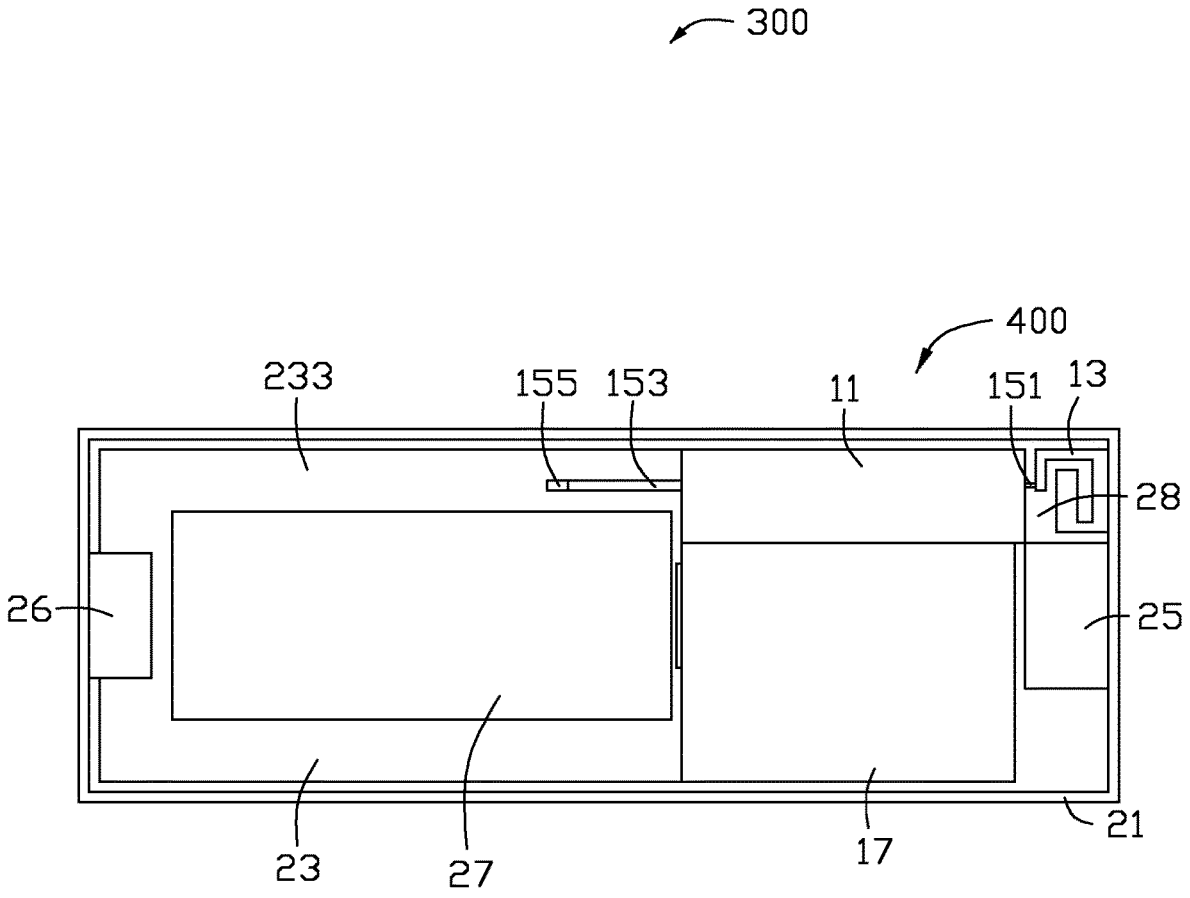
FIG. 9 is an isometric view of a second exemplary embodiment of a wireless communication device using a second exemplary antenna structure.

FIG. 9 illustrates a second exemplary wireless communication device 300. In this exemplary embodiment, the wireless communication device 300 differs from the wireless communication device 200 in that a location of the antenna structure 400 is different from the location of the antenna structure 100. The antenna body 11 and the radiator 13 of the antenna structure 400 are positioned at an upper right corner of the wireless communication device 300, that is, an upper left side of the microphone 25 of the wireless communication device 300. The coupling member 17 is positioned at a lower right corner of the wireless communication device 300, that is, a lower left side of the microphone 25 of the wireless communication device 300. At this configuration, a high frequency band of the antenna structure 400 is not affected, that is, the antenna structure 400 still has a good performance at the high frequency band.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

an antenna body;

a radiator, the radiator being a monopole antenna and spaced apart from the antenna body, wherein the radiator is coplanar with the antenna body;

a connecting member, the connecting member electrically connected to the radiator and feeding current signals to the radiator; and a coupling member;

wherein the coupling member is spaced apart from the antenna body, and the antenna body is grounded through the connecting member;

wherein the antenna body is substantially a rectangular sheet, the radiator comprises a first radiating section, a second radiating section, a third radiating section, a fourth radiating section, and a fifth radiating section connected in that order; wherein the first radiating section is parallel with one side of the antenna body;

wherein the second radiating section is perpendicularly connected to one end of the first radiating section and extends away from the antenna body; wherein one end of the third radiating section is perpendicularly connected to one end of the second radiating section away from the first radiating section, another end of the third radiating section extends along a direction parallel to the first radiating section; wherein one end of the fourth radiating section is perpendicularly connected to the end of the third radiating section away from the second radiating section, another end of the fourth radiating section extends along a direction parallel to the second radiating section and towards the antenna body until the fourth radiating section passes over the first radiating section; and wherein one end of the fifth radiating section is perpendicularly connected to the end of the fourth radiating section away from the third radiating section, another end of the fifth radiating section extends along a direction parallel to the first radiating section and towards the second radiating section.

2. The antenna structure of claim 1, wherein the connecting member is a coaxial cable and comprises an inner conductor and an outer conductor; wherein one end of the inner conductor is electrically connected to the radiator, another end of the inner conductor is electrically connected to a feed point for feeding the current signals to the radiator; and wherein one end of the outer conductor is electrically connected to the antenna body, another end of the outer conductor is grounded.

3. The antenna structure of claim 1, wherein the coupling member is a metallic back frame bracket of a wireless communication device, the coupling member is spaced apart from the antenna body and is grounded.

4. The antenna structure of claim 1, wherein the coupling member is a metallic back frame bracket of a wireless communication device, the coupling member is spaced apart from the antenna body and is not grounded.

5. A wireless communication device comprising:

an antenna structure, the antenna structure comprising:

an antenna body;

a radiator, the radiator being a monopole antenna and spaced apart from the antenna body, wherein the radiator is coplanar with the antenna body;

a connecting member, the connecting member electrically connected to the radiator and feeding current signals to the radiator; and a coupling member;

wherein the coupling member is spaced apart from the antenna body, and the antenna body is grounded through the connecting member;

a housing and a baseboard, wherein the housing forms a receiving space, the receiving space receives the antenna structure and the baseboard, the baseboard comprises a feed point and a ground plane; wherein the radiator is electrically connected to the feed point through the connecting member, and the antenna body is electrically connected to the ground plane;

a keep-out-zone, wherein the keep-out-zone is positioned in the receiving space and positioned relative to the baseboard, the radiator is positioned above the keep-out-zone, the antenna body and the coupling member are stacked in the receiving space; wherein the antenna body and the coupling member are positioned between the baseboard and the keep-out-zone;

a microphone, a Universal Serial Bus (USB) interference module, and a battery, wherein the microphone is positioned at a side of the receiving space and is positioned relative to the baseboard; wherein the USB interference module is positioned on an end of the baseboard away from the microphone, the battery is positioned at the baseboard and provides electric power to the wireless communication device; wherein the keep-out-zone is surrounded by the antenna body, the microphone, and the housing; wherein the coupling member is positioned between the baseboard and the microphone.

6. The wireless communication device of claim 5, wherein the housing is made of insulation material, the antenna body is attached to the housing.

7. The wireless communication device of claim 5, wherein the connecting member is a coaxial cable and comprises an inner conductor and an outer conductor; wherein one end of the inner conductor is electrically connected to the radiator, another end of the inner conductor is electrically connected to a feed point for feeding the current signals to the radiator; and wherein one end of the outer conductor is electrically connected to the antenna body, another end of the outer conductor is grounded.

8. The wireless communication device of claim 5, wherein the antenna body is substantially a rectangular sheet, the radiator comprises a first radiating section, a second radiating section, a third radiating section, a fourth radiating section, and a fifth radiating section connected in that order; wherein the first radiating section is parallel with one side of the antenna body; wherein the second radiating section is perpendicularly connected to one end of the first radiating section and extends away from the antenna body; wherein one end of the third radiating section is perpendicularly connected to one end of the second radiating section away from the first radiating section, another end of the third radiating section extends along a direction parallel to the first radiating section; wherein one end of the fourth radiating section is perpendicularly connected to the end of the third radiating section away from the second radiating section, another end of the fourth radiating section extends along a direction parallel to the second radiating section and towards the antenna body until the fourth radiating section passes over the first radiating section; and wherein one end of the fifth radiating section is perpendicularly connected to the end of the fourth radiating section away from the third radiating section, another end of the fifth radiating section extends along a direction parallel to the first radiating section and towards the second radiating section.

9. The wireless communication device of claim 5, wherein the coupling member is a metallic back frame bracket of a wireless communication device, the coupling member is spaced apart from the antenna body and is grounded.

10. The wireless communication device of claim 5, wherein the coupling member is a metallic back frame bracket of a wireless communication device, the coupling member is spaced apart from the antenna body and is not grounded.

11. A wireless communication device comprising:

an antenna structure, the antenna structure comprising:

an antenna body;

a radiator, the radiator being a monopole antenna spaced apart from the antenna body;

a connecting member, the connecting member electrically connected to the radiator and feeding current signals to the radiator; and a coupling member;

wherein the coupling member is spaced apart from the antenna body, and the antenna body is grounded through the connecting member;

wherein the antenna body is substantially a rectangular sheet, the radiator comprises a first radiating section, a second radiating section, a third radiating section, a fourth radiating section, and a fifth radiating section connected in that order; wherein the first radiating section is parallel with one side of the antenna body; wherein the second radiating section is perpendicularly connected to one end of the first radiating section and extends away from the antenna body; wherein one end of the third radiating section is perpendicularly connected to one end of the second radiating section away from the first radiating section, another end of the third radiating section extends along a direction parallel to the first radiating section; wherein one end of the fourth radiating section is perpendicularly connected to the end of the third radiating section away from the second radiating section, another end of the fourth radiating section extends along a direction parallel to the second radiating section and towards the antenna body until the fourth radiating section passes over the first radiating section; and wherein one end of the fifth radiating section is perpendicularly connected to the end of the fourth radiating section away from the third radiating section, another end of the fifth radiating section extends along a direction parallel to the first radiating section and towards the second radiating section.

12. The wireless communication device of claim 11, further comprising a housing and a baseboard, wherein the housing forms a receiving space, the receiving space receives the antenna structure and the baseboard, the baseboard comprises a feed point and a ground plane; wherein the radiator is electrically connected to the feed point through the connecting member, and the antenna body is electrically connected to the ground plane.

13. The wireless communication device of claim 12, wherein the housing is made of insulating material, the antenna body is attached to the housing.

14. The wireless communication device of claim 12, further comprising a keep-out-zone, wherein the keep-out-zone is positioned in the receiving space and positioned relative to the baseboard, the radiator is positioned above the keep-out-zone, the antenna body and the coupling member are stacked in the receiving space; wherein the antenna body and the coupling member are positioned between the baseboard and the keep-out-zone.

15. The wireless communication device of claim 14, further comprising a microphone, a Universal Serial Bus (USB) interference module, and a battery, wherein the microphone is positioned at a side of the receiving space and is positioned relative to the baseboard; wherein the USB interference module is positioned on an end of the baseboard away from the microphone, the battery is positioned at the baseboard and provides electric power to the wireless communication device; wherein the keep-out-zone is surrounded by the antenna body, the microphone, and the housing; wherein the coupling member is positioned between the baseboard and the microphone.

16. The wireless communication device of claim 12, wherein the connecting member is a coaxial cable and comprises an inner conductor and an outer conductor; wherein one end of the inner conductor is electrically connected to the radiator, another end of the inner conductor is electrically connected to a feed point for feeding the current signals to the radiator; and wherein one end of the outer conductor is electrically connected to the antenna body, another end of the outer conductor is grounded.

* * * * *